US006929057B1

(12) United States Patent
Sahota et al.

(10) Patent No.: US 6,929,057 B1
(45) Date of Patent: Aug. 16, 2005

(54) BUILDING HEATING ASSEMBLY

(75) Inventors: Eugene Scott Sahota, Newcastle, CA (US); Jeffrey Lee Smith, Cool, CA (US); Michael Kevin Hartsough, Placerville, CA (US); Gregory Christopher Briggs, Sacramento, CA (US); Robert Glenn Richard, El Dorado Hills, CA (US); Martin Gatsumi Goto, Sacramento, CA (US); Michael Dean Fryman, Sacramento, CA (US)

(73) Assignee: Beutler Corporation, McClellan, CA (US)

( * ) Notice: Subject to any disclaimer, the term of this patent is extended or adjusted under 35 U.S.C. 154(b) by 203 days.

(21) Appl. No.: 10/327,172

(22) Filed: Dec. 19, 2002

(51) Int. Cl.[7] ..... F25B 29/00; F24F 7/06
(52) U.S. Cl. ..... 165/48.1; 165/137; 454/233
(58) Field of Search ..... 165/67, 137, 48.1; 454/233, 236; 126/110 R, 99 R, 116 R; 62/290, 62/291

(56) References Cited

U.S. PATENT DOCUMENTS

| | | | | | |
|---|---|---|---|---|---|
| 1,978,460 | A | * | 10/1934 | Hofferberth | 454/233 |
| 2,235,607 | A | * | 3/1941 | Carraway | 454/233 |
| 3,252,508 | A | * | 5/1966 | Goettl | 165/48.1 |
| 3,750,418 | A | * | 8/1973 | Maudlin | 62/290 |
| 4,050,627 | A | * | 9/1977 | Mayer | 165/102 |
| 4,342,359 | A | * | 8/1982 | Baker | 165/137 |
| 4,424,794 | A | * | 1/1984 | Page | 126/500 |
| 4,730,668 | A | * | 3/1988 | LeMaster | 165/137 |
| 4,750,411 | A | * | 6/1988 | Eversole | 454/292 |
| 5,417,729 | A | * | 5/1995 | Greenleaf, Sr. | 55/350.1 |
| 5,429,116 | A | * | 7/1995 | Brown | 126/299 D |
| 5,927,096 | A | * | 7/1999 | Piccione | 62/298 |
| 5,964,281 | A | * | 10/1999 | Voss et al. | 165/144 |
| 2002/0051341 | A1 | * | 5/2002 | Frutschy et al. | 165/80.3 |

FOREIGN PATENT DOCUMENTS

| | | | |
|---|---|---|---|
| DE | 43 33 904 | * | 3/1995 |

* cited by examiner

*Primary Examiner*—Teresa J. Walberg
(74) *Attorney, Agent, or Firm*—Thomas R. Lampe

(57) ABSTRACT

A heating assembly for a house or other building includes a furnace module, an evaporator coil module and an adaptor module disposed between the furnace module and the evaporator coil module. Tension straps are employed to connect the modules and maintain the adaptor module in compression between the furnace module and the evaporator coil module.

12 Claims, 5 Drawing Sheets

BUILDING HEATING ASSEMBLY

TECHNICAL FIELD

This invention relates to a heating system for homes and other buildings. The system incorporates a furnace module and an evaporator coil module and unique structure for interconnecting the modules.

BACKGROUND OF THE INVENTION

The use of furnace modules and evaporator modules in home heating systems is well known. Typically, but not necessarily, assemblies incorporating these modules are located in an attic. Installation of prior art assemblies is normally accomplished in situ at the job site, the modules typically being fixedly connected together by sheet metal transitions custom fabricated from sheet metal and attached by screws. These transition structures are required to adapt the modules to one another since adjacent modules often employ different sized and/or shaped air flow openings. Sealants are usually employed to provide some semblance of air-tight connection.

This prior art approach is time consuming and typically must be carried out by highly trained personnel, further adding to cost of a project. Inconsistent results are obtained. Such installations, due to their more or less permanent character make it difficult to replace parts and components. They are also relatively long, causing installation problems.

DISCLOSURE OF INVENTION

The present invention provides an arrangement whereby a furnace module and an evaporator coil module can be quickly installed by individuals having a relatively low level of skill and experience. The structural components of the system can be disconnected and reassembled quickly and easily. A high level of air-tight integrity is provided and the invention incorporates a feature which readily allows furnace modules and evaporator coil modules of the different types to be adapted to one another in the assembly.

The invention relates to a combination including a furnace module having a furnace module interior and a furnace module outlet opening in air-flow communication with the furnace module interior.

The combination further includes an evaporator coil module having an evaporator coil module interior and an evaporator coil module inlet opening in air-flow communication with the evaporator coil module interior.

An adaptor module is connected to and disposed between the furnace module and the evaporator coil module having an adaptor module inlet opening thereof adjacent to the furnace module outlet opening and in air-flow communication therewith for receiving air from the furnace.

The adaptor module also has an adaptor module outlet opening adjacent to the evaporator coil module inlet opening and in air-flow communication therewith for introducing air received by the adaptor module from the furnace module into the evaporator coil module through the evaporator coil module inlet.

The assembly also includes air seal structure surrounding the adaptor module inlet opening and the adaptor module outlet opening and disposed between the adaptor module and the furnace module and between the adaptor module and the evaporator coil module.

Securement structure exerts forces on the furnace module and on the evaporator coil module continuously urging them toward one another whereby the adaptor module is maintained under compression between the furnace module and the evaporator coil module and fixed in position relative thereto.

Other features, advantages and objects of the present invention will become apparent with reference to the following description and accompanying drawings.

MODES FOR CARRYING OUT THE INVENTION

Figure 1:
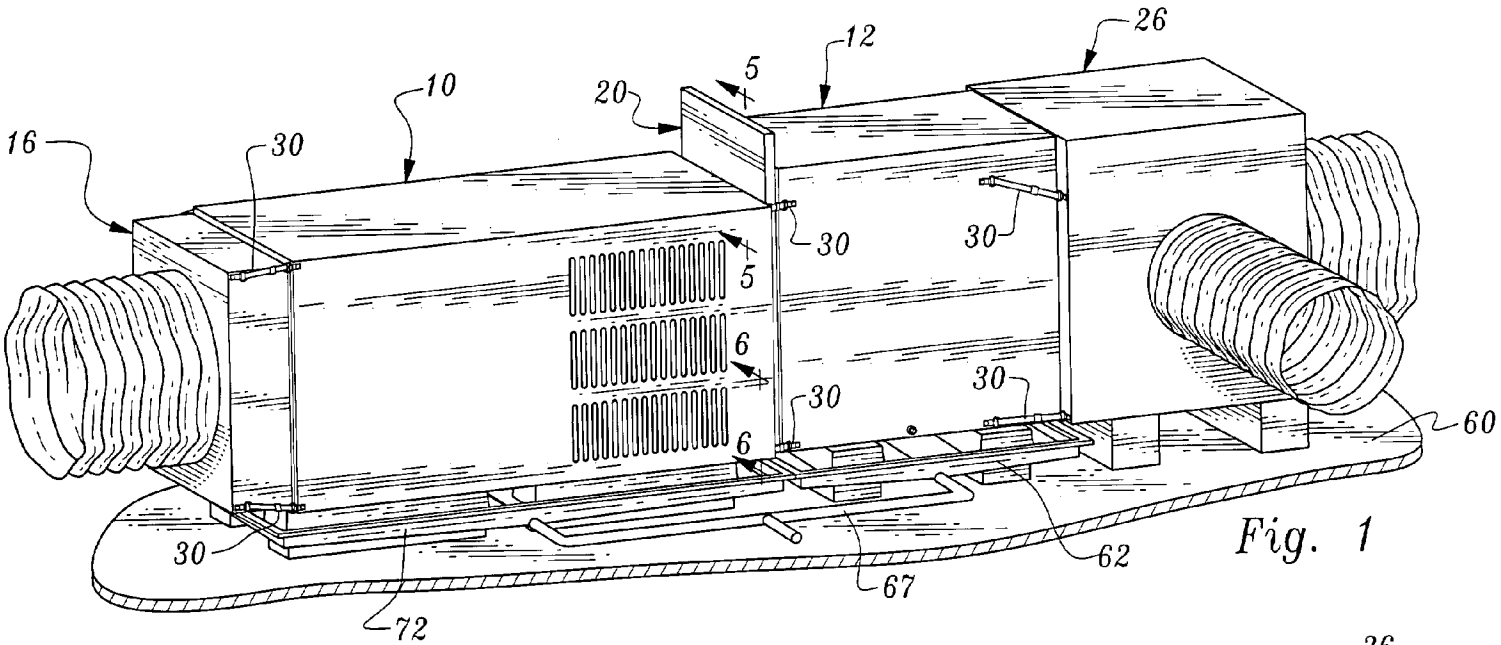
FIG. 1 is a side, perspective view illustrating a preferred embodiment of the present invention and including a horizontal furnace module, an evaporator coil module and an adaptor module maintained in end-to-end relationship.
Figure 2:
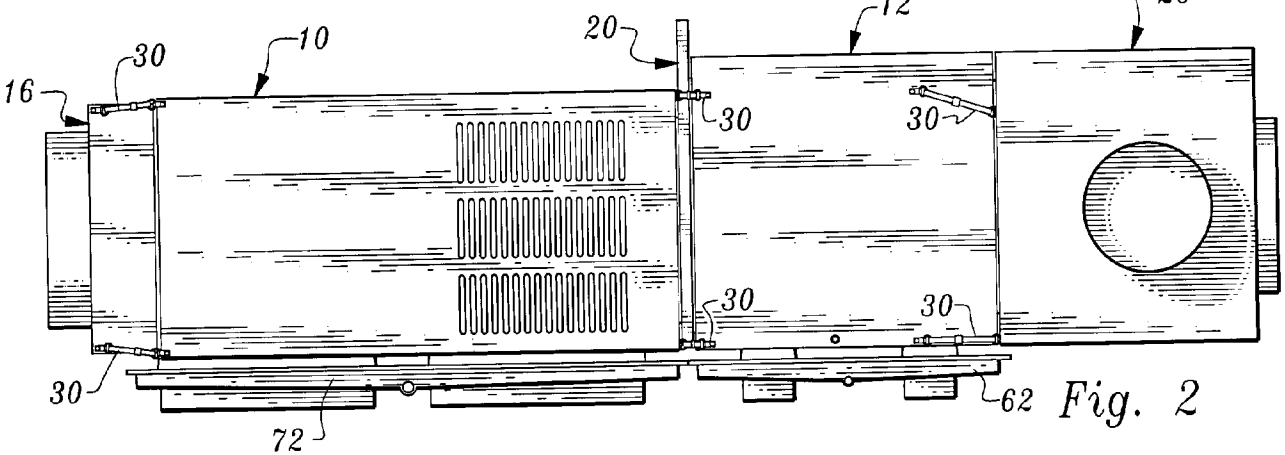
FIG. 2 is a side, elevational view of the assembly.
Figure 3:
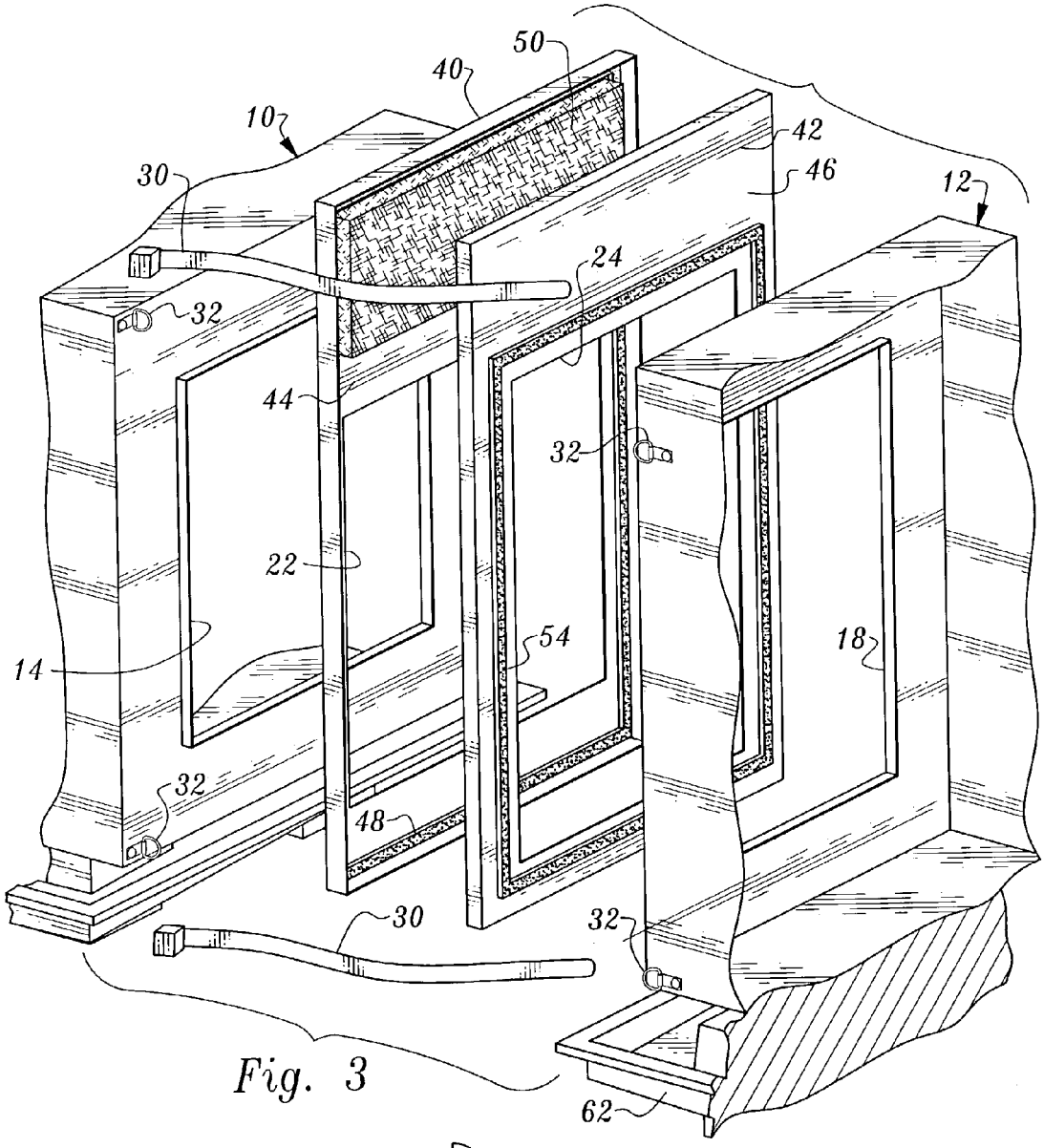
FIG. 3 is an enlarged, exploded view illustrating selected portions of the assembly.
Figure 4:
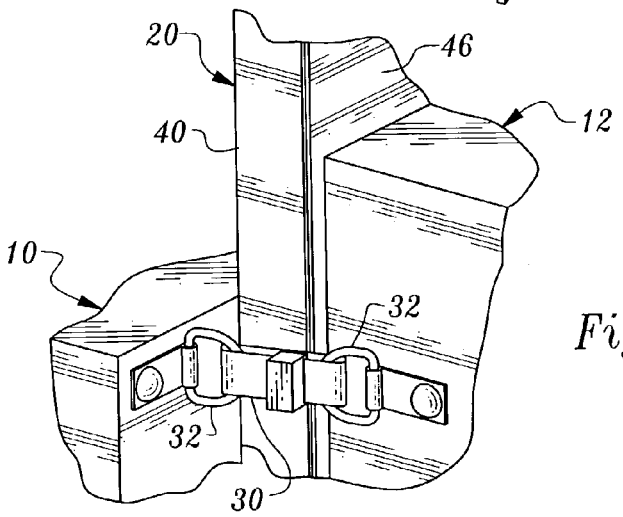
FIG. 4 is an enlarged, perspective view illustrating details of structure utilized to releasably interconnect modules of the assembly.
Figure 5:
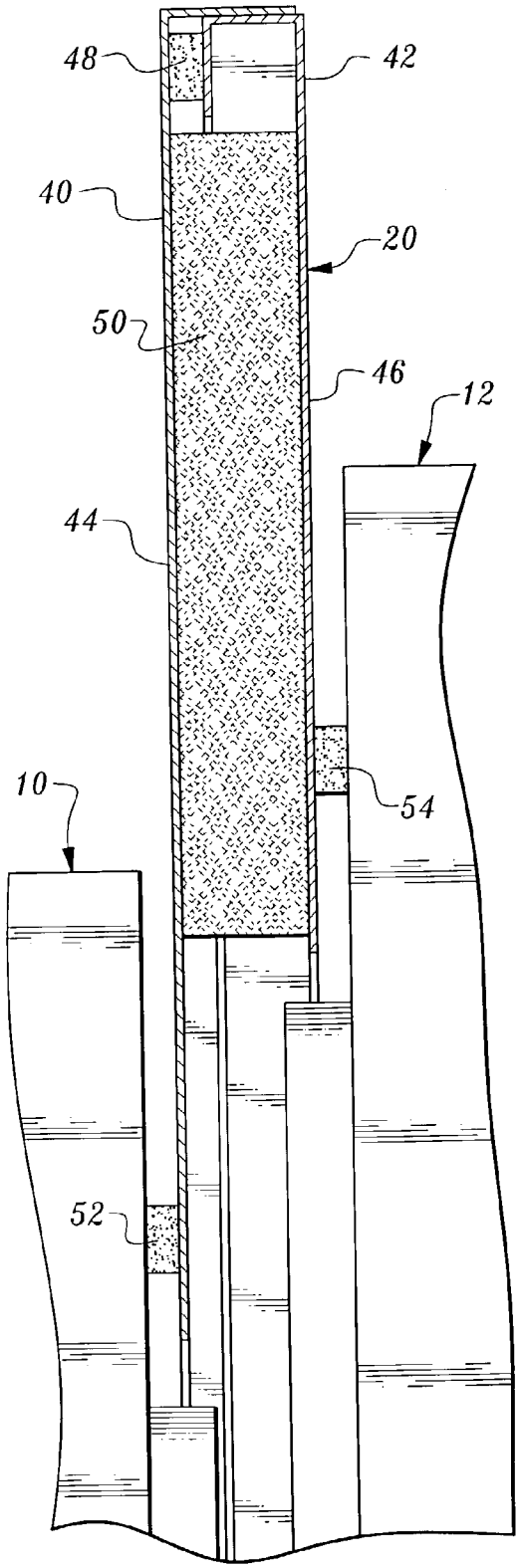
FIG. 5 is a greatly enlarged cross-sectional view taken along the line 5—5 in FIG. 1.
Figure 6:
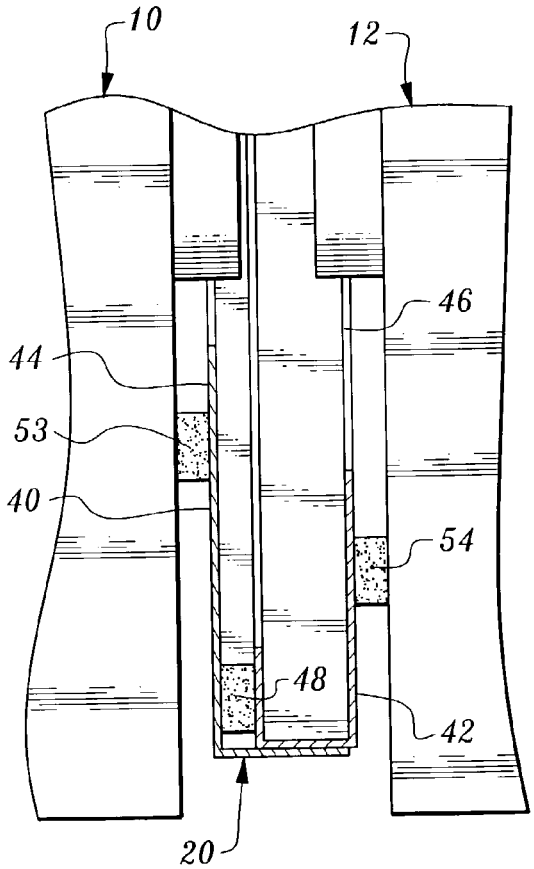
FIG. 6 is a greatly enlarged cross-sectional view taken along the line 6—6 of FIG. 1.
Figure 7:
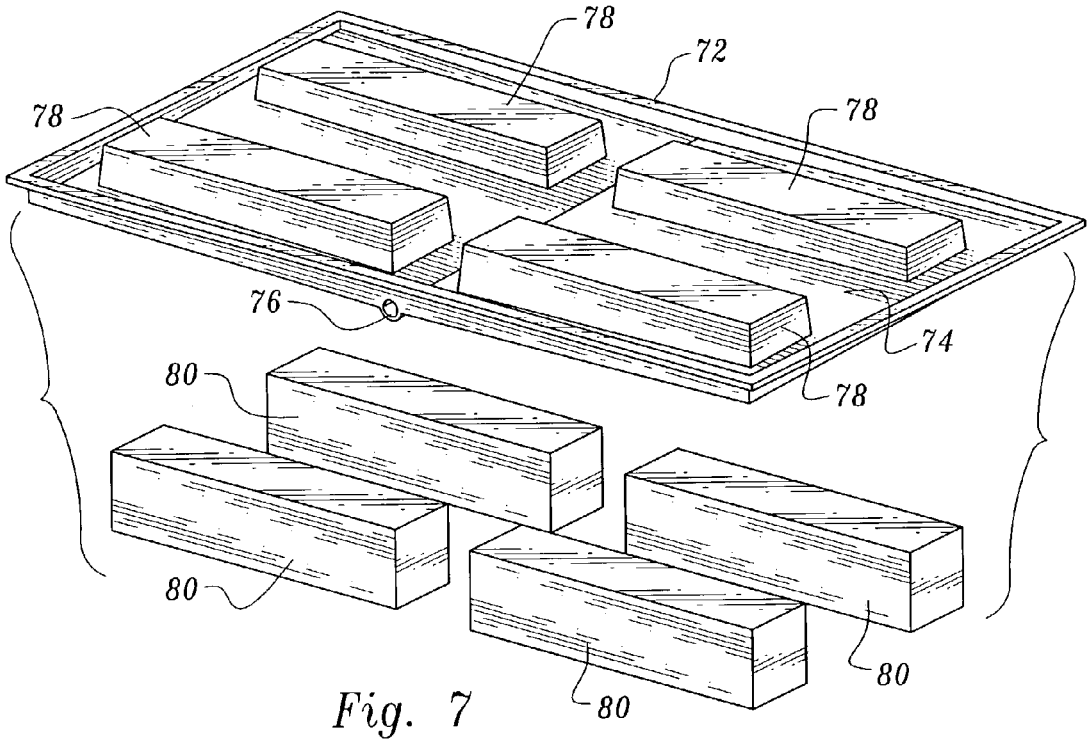
FIG. 7 is a perspective, exploded view of a condensate pan for positioning under the furnace module as well as support blocks for positioning in receptacles of the pan.
Figure 8:
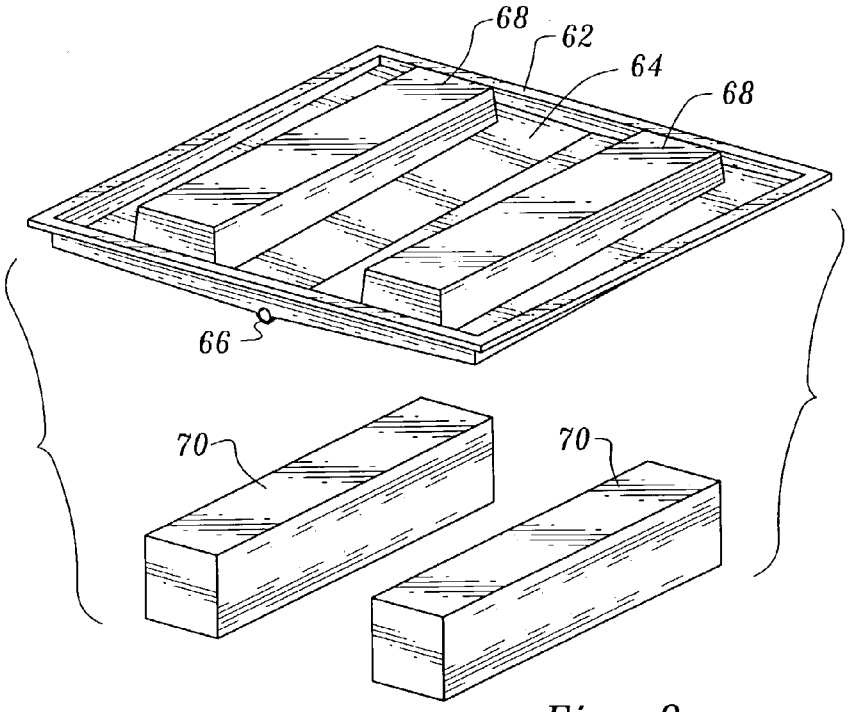
FIG. 8 is a view similar to FIG. 7, but illustrating a condensate pan and support blocks employed to support the evaporator coil module and for receiving condensate therefrom.

Referring now to FIGS. 1–8, a preferred embodiment of a heating system assembly constructed in accordance with the teachings of the present invention is illustrated. The assembly includes a horizontal furnace module 10 and an evaporator coil module 12. These modules may be of any suitable well known type. The furnace module 10, as is well known, defines a furnace module outlet opening 14 in air-flow communication with the furnace module interior. In the arrangement illustrated, the inlet opening (not shown) of the furnace module receives air from a module 16 having an air intake duct connected thereto.

Evaporator coil module 12 has an evaporator coil module inlet opening 18 in air-flow communication with the evaporator coil module interior.

An adaptor module 20 is connected to and disposed between the furnace module and the evaporator coil module. The adaptor module has an adaptor module inlet opening 22 adjacent to the furnace module outlet opening 14 and in air-flow communication therewith for receiving air from the furnace.

The adaptor module also has an adaptor module outlet opening 24 adjacent to the evaporator coil module inlet opening 18 and in air-flow communication therewith for introducing air received by the adaptor module from the furnace module into the evaporator coil module through the evaporator coil module inlet. A plenum module 26 associated with outlet ducts is connected at the distal end of the evaporator coil module 12 to receive air from an evaporator coil module outlet opening (not shown).

The modules of the illustrated assembly are held together by securement structure which includes tensioned securement straps 30 and strap retainers in the form of rings or loop elements 32 attached to the modules. The securement straps may for example be commercially available "zip" cable ties constructed of nylon or the like. Each securement or attachment strap 30 extends between retainers 32 of adjacent modules. A tool (not shown) of a well known type may be employed to tension the straps and pull the modules together in tight engagement.

The forces exerted on the furnace module and on the evaporator coil module continuously urge the furnace module and the evaporator coil module toward one another to maintain the adaptor module 20 under compression therebetween and fixed in position relative thereto. Disassembly of selected modules is readily effected by severing the straps connecting them together.

The adaptor module includes an adaptor module component 40 defining adaptor module inlet opening 22 and an adaptor module component 42 defining the adaptor module outlet opening 24. As may perhaps best be seen with reference to FIGS. 5 and 6, in the arrangement illustrated, the adaptor module component 42 seats within the confines of a peripheral outer wall of the adaptor module component 40.

Adaptor module component 40 includes a plate 44 and adaptor module component 42 includes a plate 46. These plates are disposed parallel to one another in the embodiment being described. A gasket 48 is disposed between the plates and surrounds the adaptor module inlet opening 22 and the adaptor module outlet opening 24 to prevent the escape of air between the adaptor module components. In the arrangement illustrated, insulation 50 is provided at the upper end of the adaptor module. Compression of the adaptor module by the furnace module and the evaporator coil module results in compression of gasket 48 and insulation 50.

Air seal structure in the form of compressive seal strips 52, 54 are located respectively on adaptor module components 40, 42. Compressive seal strip 52 surrounds adaptor module inlet opening 22 and compressive seal strip 54 surrounds adaptor module outlet opening 24. Thus, air is prevented from escaping between the adaptor module and the furnace module and evaporator coil module.

The two component nature of the adaptor module enables either component to be replaced with another having a different sized or shaped opening formed therein. This approach enables an adaptor module to be customized for a particular furnace module outlet opening and particular evaporator coil module inlet opening so that the furnace module and evaporator coil module are compatible and meet specification. It will be appreciated that the sizes and shapes of such openings vary between manufacturers and even between models of a single manufacturer.

The evaporator coil 12 module is supported on an attic floor or other support surface 60 (FIG. 1) by a condensate pan 62 which may, for example, be formed of molded plastic, fiberglass or the like. Condensate pan 62 has a pan bottom 64 (see FIG. 8) which inclines downwardly toward a condensate outlet 66 defined by the pan to direct condensate thereto. Outlet 66 communicates with a conduit 67 (FIG. 1) which delivers the condensate to a desired location.

The condensate pan 62 includes hollow receptacles 68 which are open at the bottoms thereof. The receptacles 68 have upper support surfaces engaging and supporting the evaporator coil module.

The receptacles 68 accommodate therein support members in the form of blocks 70 suitably formed of styrofoam or other foamed plastic material. The blocks 70 project downwardly from the pan bottom and support the pan as well as the evaporator coil module on the flooring or other support surface. The blocks 70 may be cut at the job site to provide a height ensuring leveling and proper height placement of the evaporator coil module relative to associated modules and components.

A somewhat larger condensate pan 72 (FIG. 7) is located under horizontal furnace module 10 and includes an inclined pan bottom 74 leading to outlet 76, the latter also being connected to conduit 67. Receptacles 78 project upwardly from pan bottom 74 to support the furnace module and accommodate plastic foam blocks 80, which also may be cut to size as desired.

Figure 10:
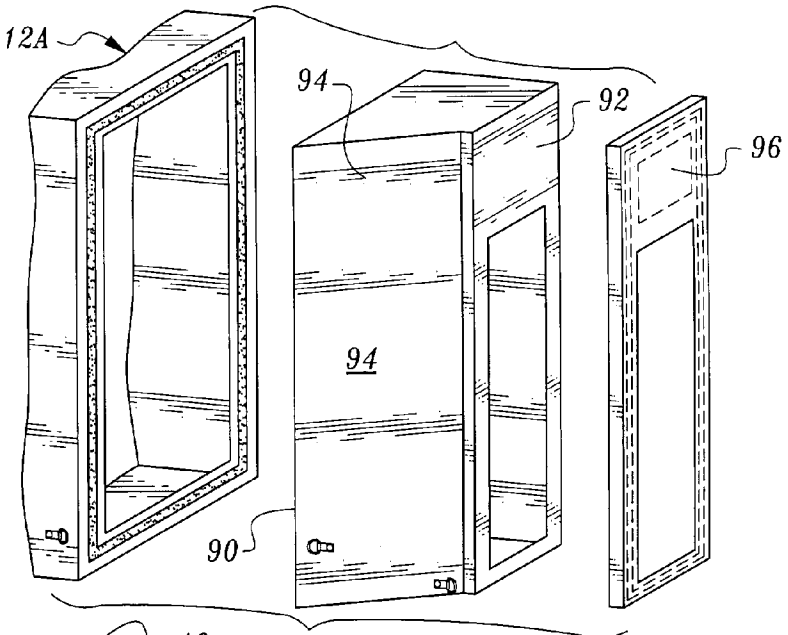
FIG. 10 is an exploded, perspective view illustrating components of an adaptor module employed in the arrangement of FIG. 9 prior to interconnection thereof to the inlet end of an evaporator coil module.
Figure 11:
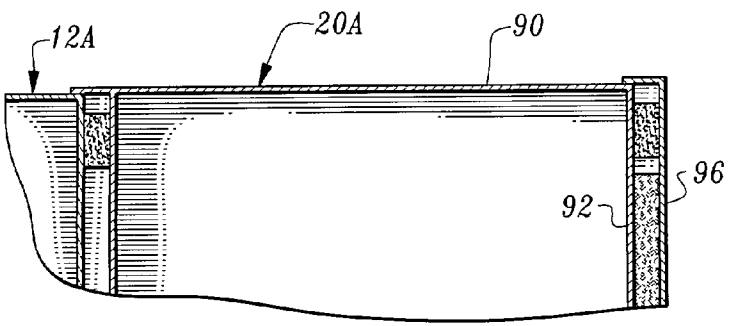
FIG. 11 is an enlarged, cross-sectional view taken along the line 11—11 in FIG. 9.
Figure 9:
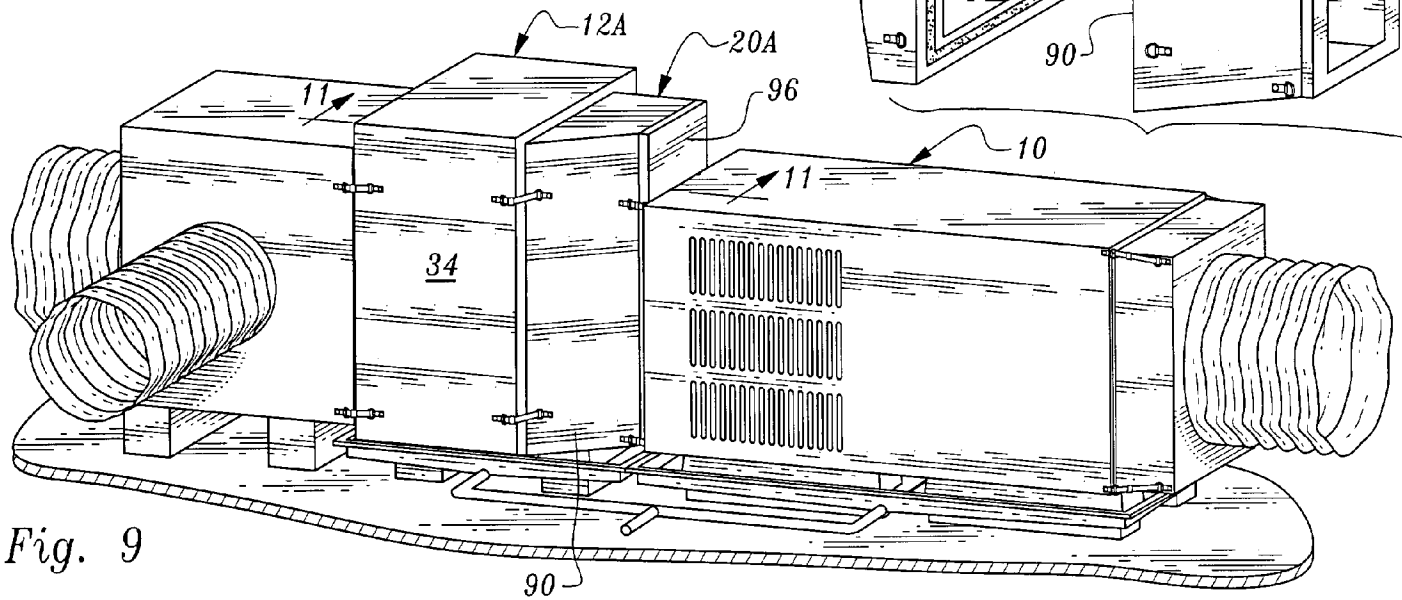
FIG. 9 is a view similar to FIG. 1, but illustrating an alternative embodiment of the invention.

FIGS. 9–11 illustrate an alternative form of the assembly wherein evaporator coil module 12A has a different configuration than module 12 of FIGS. 1–8. Also, in this embodiment, one of the two components of the adaptor module 20A, component 90, includes not only a plate 92 but also a tapered peripheral wall 94 attached to and extending from plate 92. The wall diverges outwardly in the direction of wider evaporator coil module 12A to provide a smooth transition with that module. Adaptor module component 96 is in the nature of a plate maintained in compression against plate 92.

What is claimed is:

1. In combination:

a furnace module having a furnace module interior and a furnace module outlet opening in air-flow communication with said furnace module interior;

an evaporator coil module having an evaporator coil module interior and an evaporator coil module inlet opening in air-flow communication with said evaporator coil module interior;

an adaptor module connected to and disposed between said furnace module and said evaporator coil module having an adaptor module inlet opening adjacent to said furnace module outlet opening and in air-flow communication therewith for receiving air from said furnace and an adaptor module outlet opening adjacent to said evaporator coil module inlet opening and in air-flow communication therewith for introducing air received by said adaptor module from said furnace module into said evaporator coil module through said evaporator coil module inlet;

air seal structure surrounding said adaptor module inlet opening and said adaptor module outlet opening and disposed between said adaptor module and said furnace module and between said adaptor module and said evaporator coil modules;

securement structure including a plurality of tensioned securement straps extending between said furnace module and said evaporator coil module exerting forces on said furnace module and on said evaporator coil module continuously urging said furnace module and said evaporator coil module toward one another whereby said furnace module and said adaptor module apply opposed compressive forces on said adaptor module to maintain said adaptor module under compression between said furnace module and said evaporator coil module and in a predetermined position relative thereto, and whereby said air seal structure is simultaneously compressed between said adaptor module and said furnace module and between said adaptor module and said evaporator coil module, said adaptor module including a first adaptor module component having a first plate defining said adaptor module inlet opening and a second adaptor module component having a second plate spaced from said first plate defining said adaptor module outlet opening, said first adaptor module component and said second adaptor module component being releasably connected to one another to selectively allow either of said first and second adaptor module components to be replaced to adapt to different sizes of furnace module outlet openings and evaporator coil module inlet openings; and a gasket between said first and second plates and surrounding said adaptor module inlet opening and said adaptor module outlet opening, said casket being compressed between said first and second plates to substantially prevent leakage of air passing between said adaptor module inlet opening and said adaptor module outlet opening.

2. The combination according to claim 1 wherein said securement structure additionally includes strap retainers attached to said furnace module and said evaporator oil module, at least some of said tensioned securement straps extending between said strap retainers.

3. The combination according to claim 1 wherein said securement structure additionally includes strap retainers on said adaptor module, said furnace module, and said evaporator coil module, said tensioned securement straps extending between different pairs of said strap retainers.

4. The combination according to claim 1 wherein said first and second plates are substantially parallel.

5. The combination according to claim 4 wherein at least one of said first and second adaptor module components additionally comprises a tapered peripheral wall attached to and extending from the plate thereof.

6. The combination according to claim 1 additionally comprising a condensate pan located under at least one of said evaporator coil module and said furnace module to catch condensate therefrom.

7. The combination according to claim 6 wherein said condensate pan supports and elevates at least one of said evaporator coil module and said furnace module.

8. The combination according to claim 6 wherein said condensate pan defines a condensate outlet, said condensate pan including a pan bottom inclined downwardly toward said condensate outlet to direct condensate thereto.

9. The combination according to claim 1 wherein said condensate pan includes a pan bottom, said combination additionally comprising support members extending downwardly from said pan bottom to a support surface and supporting said condensate pan.

10. The combination according to claim 9 wherein said support members comprise blocks formed of plastic foam material.

11. The combination according to claim 9 wherein said condensate pan additionally includes a plurality of receptacles open at bottoms thereof receiving said support members, said receptacles having upper support surfaces engaging and supporting at least one of said furnace module and said evaporator oil module.

12. The combination according to claim 1 additionally comprising a first condensate pan located under and supporting said evaporator coil module and a second condensate pan located under and supporting said furnace module, said first and second condensate pans each defining a condensate outlet, said combination additionally including a conduit leading from the condensate outlet of each of said first and second condensate pans.

* * * * *